United States Patent [19]

Bowsky

[11] 4,296,275

[45] Oct. 20, 1981

[54] HERMETIC REFRIGERATION TERMINAL

[75] Inventor: Benjamin Bowsky, Maineville, Ohio

[73] Assignee: Emerson Electric Co., St. Louis, Mo.

[21] Appl. No.: 157,411

[22] Filed: Jun. 9, 1980

[51] Int. Cl.[3] ..... H01B 17/26

[52] U.S. Cl. ..... 174/152 GM; 339/192 RL

[58] Field of Search ..... 174/50.56, 50.58, 50.61, 174/50.63, 151, 152 R, 152 GM; 339/192 RL

[56] References Cited

U.S. PATENT DOCUMENTS 2,079,354 5/1937 Knowles ..... 174/152 GM X
2,344,280 3/1944 Beggs ..... 174/152 GM X
3,160,460 12/1964 Wyzenbeek ..... 174/152 R X

FOREIGN PATENT DOCUMENTS 2800696 7/1979 Fed. Rep. of Germany ..... 174/152 GM

*Primary Examiner*—Laramie E. Askin
*Attorney, Agent, or Firm*—Polster, Polster and Lucchesi

[57] ABSTRACT

In a hermetic refrigeration terminal with a cup-shaped body having a bottom wall and at least one opening in the bottom wall defined by an annular lip extending into the cup, and a current carrying pin extending through the opening and beyond the lip on both ends, and a seal bonding the pin to an inside surface of the lip, a flange is provided extending generally radially from the pin and located axially between the lip and the inner end of the pin, and an electrically insulating sleeve surrounding the pin and extending axially between the flange and the lip, the sleeve being at least in part larger in diameter than the opening and being bonded at its end opposite the flange to the seal.

13 Claims, 9 Drawing Figures

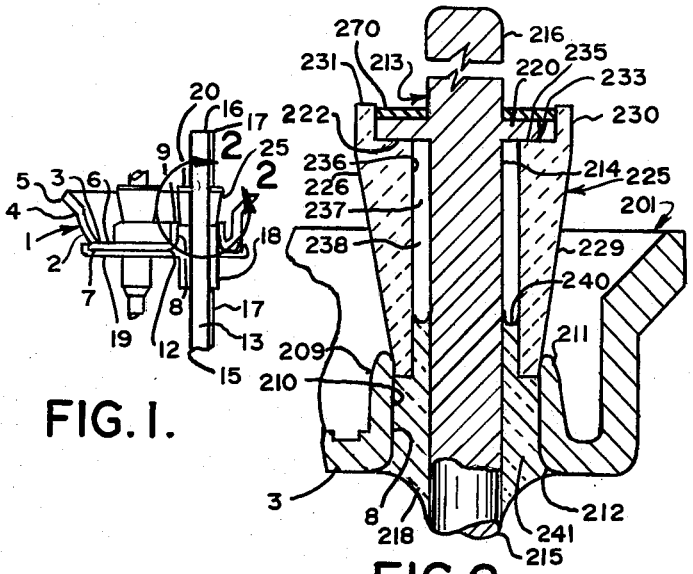
FIG. 1.
FIG. 2.
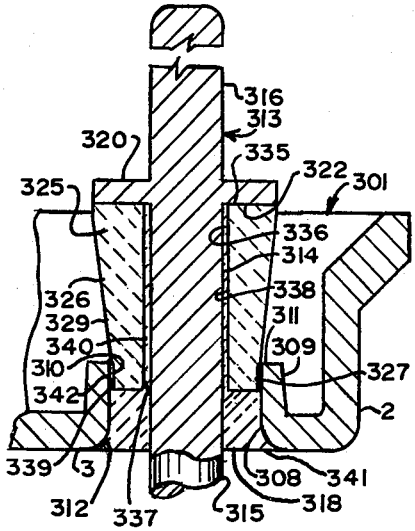
FIG. 3.
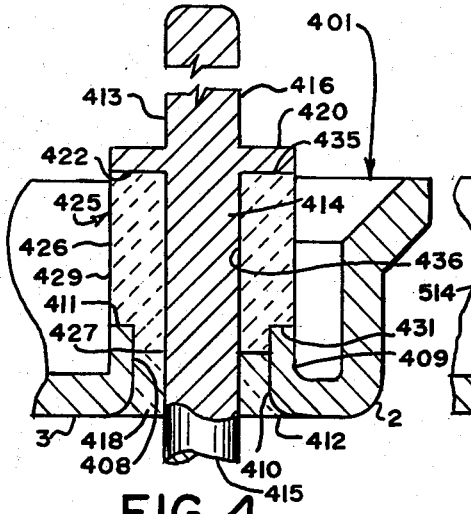
FIG. 4.
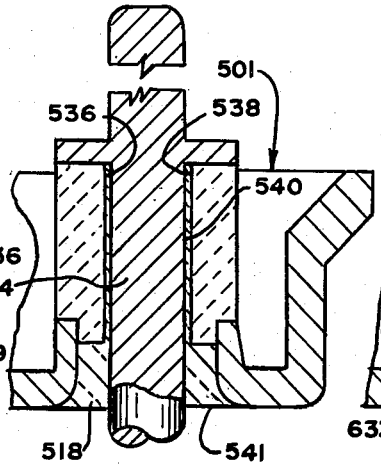
FIG. 5.
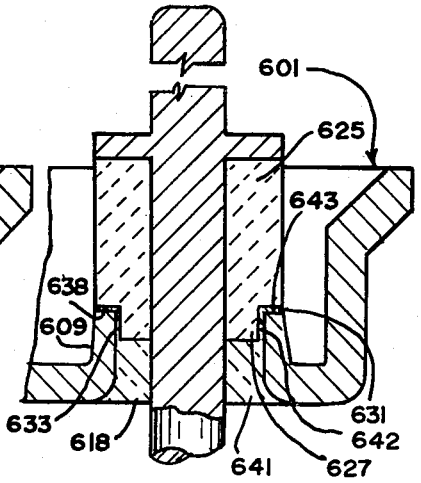
FIG. 6.
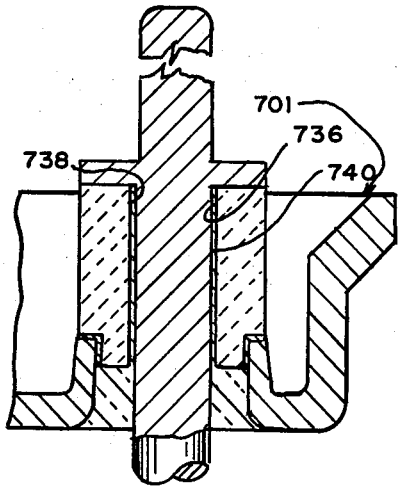
FIG. 7.
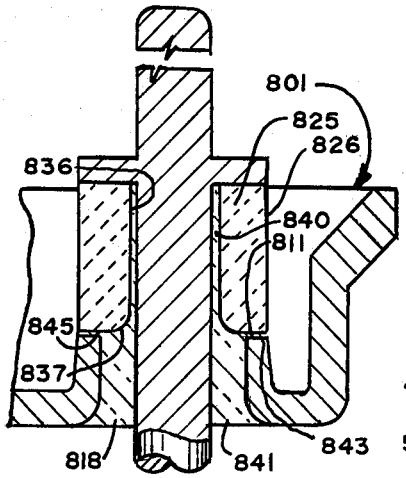
FIG. 8.
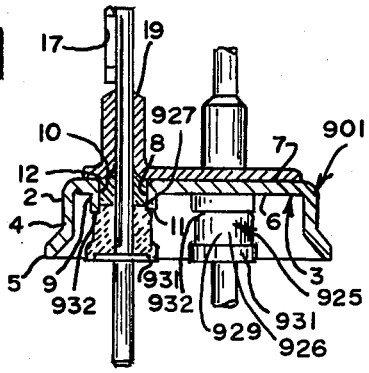
FIG. 9.

HERMETIC REFRIGERATION TERMINAL

BACKGROUND OF THE INVENTION

In a conventional hermetic refrigeration assembly, exemplified by Wyzenbeek U.S. Pat. No. 3,160,460, a straight, current carrying pin is sealed in place within a lip defining a hole in the terminal body, by means of fusible glass. Under certain circumstances of motor or compressor failure, a conductive deposit can form on the surface of the glass, and on the inner surfaces of the terminal parts between adjacent terminal pins, leading to arcing, which in turn, leads to surface damage to the glass seal. The failure also can lead to the build up of pressure within the hermetic shell, and it has happened that as a repairman is working on or inspecting the device, a pin has vented releasing noxious gases.

One of the objects of the present invention is to provide a hermetic refrigeration terminal that eliminates or minimizes the chance of such an accident. Another object is to provide such a terminal which is simple and economical to manufacture.

The problem of providing a seal for an electrical terminal subjected to high pressure has been approached in various ways heretofore. Lynch U.S. Pat. No. 3,134,230 shows a terminal pin with an integral flange positioned between a ceramic washer and a glass sleeve for use in a pressure bomb or rocket motor. Clark U.S. Pat. No. 2,994,325 and Abrams U.S. Pat. No. 3,005,039 are other assemblies of terminal pins with flanges.

SUMMARY OF THE INVENTION

In accordance with this invention, generally stated, a hermetic refrigeration terminal having a cup-shaped body with a generally flat bottom wall and at least one opening in the bottom wall defined by an annular lip extending into the cup, a current carrying pin extending through the opening and beyond the lip on both ends thereof, the inner end of the pin being on the dish side and the outer end, on the outer side of the body, and a seal bonding the pin to an inside surface of the lip, has a flange extending generally radially from the pin and located axially between the lip and the inner end of the pin and an electrically insulating sleeve surrounding the pin and extending axially between the flange and the lip, the sleeve being at least in part larger in diameter than the opening and being bonded at its end opposite the flange to the seal.

BRIEF DESCRIPTION OF THE DRAWINGS

In the drawing, FIG. 1 is a view in side elevation, partly broken away, of a hermetic refrigeration terminal illustrating the general features of this invention;

FIG. 2 is a sectional view of the portion of the terminal shown in FIG. 1 indicated by the line 2—2 of FIG. 1 and illustrating one specific embodiment;

FIG. 3 is a sectional view similar to that of FIG. 2 showing a second embodiment;

FIG. 4 is a similar sectional view showing a third embodiment;

FIG. 5 is a similar sectional view showing a fourth embodiment;

FIG. 6 is a similar sectional view showing a fifth embodiment;

FIG. 7 is a similar sectional view showing a sixth embodiment;

FIG. 8 is a similar sectional view showing a seventh embodiment; and

FIG. 9 is a sectional view diametrically through a hermetic refrigeration terminal, illustrating an eighth, and preferred embodiment of this invention.

DESCRIPTION OF THE PREFERRED EMBODIMENTS

Referring now to the drawing for illustrative embodiments of this invention, reference numeral 1 indicates an assembled hermetic terminal having a cup-shaped body 2 with a generally flat bottom 3 and side wall 4 with an outwardly flaring rim 5. The bottom has a dish side surface 6, an outside surface 7, and an opening 8 defined by an annular lip 9 with an inside wall surface 10 (see FIG. 9), a free edge 11 on the dish side and a radius 12 on the outside. These elements are common to all the embodiments.

Referring now to FIG. 1, a current carrying pin 13 with an outer end 15 and an inner end 16 has conventional terminal tabs 17. The current carrying pin 13 is sealed within the opening 8 by a seal 18. Conventionally, the outside surface of the bottom wall and a part of the projecting outer end of the terminal pin are covered by an insulating material such as epoxy or silicone rubber 19.

The current carrying pin 13 of this invention has an integral generally radially projecting flange 20. A sleeve 25 is mounted around the pin between the flange and the lip, and is bonded to the lip and to the terminal by the seal 18.

Referring to FIG. 2 for one particular illustrative embodiment 201 of this invention, the opening 8 in the bottom 3 is defined by an annular lip 209 with an inside wall 210, a free edge 211, which in this embodiment is shown as somewhat rounded, and a radius 212. A current conducting pin 213 with a shank 214, and inner end 216, and an outer end 215, has a flange 220 that is larger in diameter than the inside diameter of the opening 8 through the upper portion of the inside wall 210.

The flange 220 has a flat surface 222 facing the lip 209. A sleeve 225, which in this illustrative embodiment is ceramic such as alumina or steatite, with an outside wall 226 which includes a tapered portion 229 and a cylindrical portion 230, has at its upper end a stepped seat 233 defined by an annular wall 231 and a flat surface 235. The ceramic sleeve 225 also has a cylindrical bore 237 defined by an inside wall 236. The ceramic sleeve 225 is seated within the upper portion of the opening 8, with its outside wall in contact with the inside wall 210 of the annular lip, and the pin 213 is seated within the ceramic sleeve, with the flange 220 seated within the stepped seat 233 and the shank 214 within the bore 237. The bore 237 is larger in diameter than the shank 214 so as to leave a substantial space 238 between the shank and the inside wall 236.

In this embodiment, seal 218 is glass and has a neck 240 extending for about a quarter of the distance from the bottom edge of the ceramic sleeve, between the inside wall 236 and the shank 214 of the pin, and bonding the two to one another, and a body portion 241, extending between the inside wall 210 of the lip, the bottom edge of the ceramic sleeve and the shank 214, bonding them all together.

In this embodiment, in which a space exists between the sleeve and the pin through a part of their mutual reach, a sealing medium 270 approved for use in hermetic motor applications such as epoxy, silicone or motor varnish or even glass can be contained in the dish-like cavity provided by the wall 231, to seal the space against the ingress of foreign material.

In FIG. 3, a second embodiment 301, is illustrated. The bottom 3 of the body 2 in this embodiment has an opening 308 defined by an annular lip 309 with an inside surface 310, a free edge 311, which in this embodiment, is substantially flat, and a radius 312. A current conducting pin 313 has a shank 314, an inner end 316, an outer end 315, and a flange 320. The flange 320 in this embodiment has a diameter at least as great as the outside diameter of the annular lip 309 at its free edge 311. The underside of the flange 320 has a generally flat radial surface 322.

A sleeve 325 in this embodiment has an outside wall 326 with a tapered portion 329 and a cylindrical nose portion 327. The sleeve 325 also has a flat top surface 335 and a bore 337 defined by an inside wall 336. The bore 337 is slightly larger than the shank 314, so as to leave a space 338. In this embodiment, the nose 327 is mounted within the opening 308, and is centered by the impingement of the tapered portion 329 on the upper edge of the inside surface 310, leaving a space 339 between the nose and the inside surface 310.

In this embodiment, a seal 318 has a neck 340 that extends the length of the bore 337 of the sleeve, a body 341 and a collar 342. The neck 340 bonds the shank 314 to the inside wall 336, the collar 342 bonds the nose 327 to the inside surface 310, and the body 341 bonds all three.

In FIG. 4, a third embodiment 401 is illustrated. The bottom 3 of the body 2 in this embodiment has an opening 408 defined by an annular lip 409 with an inside surface 410, a free edge 411, which in this embodiment, is substantially flat, and a radius 412. A current conducting pin 413 has a shank 414, an inner end 416, an outer end 415 and an integral, radially projecting flange 420. The flange 420 in this embodiment has a diameter equal to the outside diameter of the annular lip 409 at its free edge 411. The underside of the flange 420 has a flat radial surface 422.

The sleeve 425 in this embodiment has an outside wall 426 at the lower end of which is a cylindrical nose 427 of a diameter to fit closely within the opening 408 and a cylindrical portion 429 of a diameter equal to the outside diameter of the lip 409 at its free edge 411. The nose 427 and portion 429 of larger diameter are coaxial, and define between them a step with a flat surface 431 that bears upon the flat surface of the free edge 411. the underside 422 of the flange 420 bears against a flat top surface 435 of the sleeve 425.

In this embodiment, an inside wall 436 of the sleeve is of a diameter closely to fit with the shank 414.

In this embodiment, a seal 418 bonds the lip to a broad flat bottom surface of the nose portion 427 and to the shank 414.

In FIG. 5 a fourth embodiment 501 is illustrated. The embodiment of FIG. 5 is substantially the same as the embodiment shown in FIG. 4 but for the fact that a seal 518 in the present embodiment has a body 541 and a neck 540, extending through the length of a space 538 between an inside wall 536 and a shank 514 of the current conducting pin.

In FIG. 6 a fifth embodiment 601 is illustrated. The embodiment 601 differs from the embodiment 401 in that a sleeve 625 has a nose 627 with an outside diameter smaller than the inside diameter of a lip 609. Both the nose 627 and a flat surface 631 of the sleeve 625 are spaced from the lip 609, to leave an axial space 633 and a radial space 638 between the sleeve and lip. A seal 618 has a body 641, a collar 642 and an annular seal 643, all integral. The seal 643 bonds the surface 631 of the sleeve to the flat upper surface of the lip 609, the collar 642 bonds the nose of the sleeve to the inside surface of the lip, and the body 641 bonds the lip, sleeve and shank together.

In FIG. 7, a sixth embodiment 701 is illustrated. The embodiment 701 is the same as the embodiment 601 except that an inside wall 736 of the sleeve defines a bore of larger diameter than the shank of the pin, to provide a space 738, into which a neck 740 of sealing material extends.

In FIG. 8, a seventh embodiment 801 is illustrated. In this embodiment, a sleeve 825 has an outside wall 826 that is uniformly cylindrical, and an inside wall 836, of a diameter greater than the outside diameter of the shank of the current conducting pin, and with a radius 837 at its lower edge, between the inside wall 836 and a flat bottom surface 845. The flat surface 845 is spaced from a flat surface 811 of the lip, and a seal 818 has a body 841, a neck 840 extending the length of the space between the inside wall 836 of the sleeve and the shank of the pin, and a radially extending annular seal 843.

In FIG. 9, an eighth embodiment 901 is illustrated. In this embodiment, a sleeve 925 has an outside wall 926 that is generally cylindrical but stepped to provide a nose 927 that fits closely within the bore of the lip, a body section 929 and an annular rim portion 931 defining with a flat surface on the body 929 a seat for the flange of the conductive pin, much as in the embodiment 201. The nose 927 is smaller in diameter than the body 929, and the bridging surface between the outside surfaces of the nose and body is a chamfer 932. The diameter of the annular rim 931 is greater than that of the body 929, and the two are joined by a radius. In this embodiment, the shank of the current conducting pin fits closely within the bore of the sleeve, as in the embodiments 401 and 601, and, as in the embodiment 401, a seal bonds the inner wall of the lip, a flat surface of the nose and the pin shank. This embodiment is considered to be the preferred embodiment.

The manufacture of the various embodiments will be readily apparent to those skilled in the hermetic refrigeration terminal art.

In the operation of the refrigeration terminal of this invention, in the embodiments 201, 301, and 901, if the seal should give way under pressure, the taper, or in the case of 901, the chamfer of the sleeve, tends to wedge the lip outwardly to double it over and in effect create a strong reinforcement within which the body, and in the case of the embodiment 901, the rim, will be held. In the embodiments 401 through 801, the sleeve, resting upon the upturned edge of the lip makes it difficult for the assembly to come out of the cup unless the metal ruptures. Inasmuch as the cups are made of heavy gage steel, this is unlikely, so that the area of the current conducting pin is not a particular point of weakness.

Numerous variations in the construction of the hermetic refrigeration terminal of this invention, within the scope of the appended claims, will occur to those skilled in the art in the light of the foregoing disclosure. Merely by way of example, the current conducting pin flange can be welded either as a washer or as part of a terminal tab, or can even be made in the form of a snap ring fitting within a groove in the pin, or a star washer. The flange can be dished, extending toward the sleeve at an acute angle with respect to the current conducting pin, in which case the uppermost surface of the sleeve can be relieved, generally complementarily to the angle of the flange. Such a construction would still be embraced within the term "generally radially" as applied to the extending of the flange. Various permutations and combinations of the eight different embodiments shown can be employed. The face of the sleeve facing the upper surface of the lip can be formed so as to incline inwardly upwardly, thus tending to force the lip inwardly if the glass seal gives way. The sleeve is preferably made of ceramic but any suitable electrically insulating material with high strength in compression, that is unaffected by refrigerant can be used. Among materials presently approved for use inside hermetic compressors are phenolic molding compounds, polyester molding composition (e.g. Dacron), polyethylene terephthalate (e.g. Mylar), polytetrafluoroethylene (e.g. Teflon), Dacron, Mylar and Teflon all being products of E. I. DuPont de Nemous & Co., and epoxy resins. Similarly, although the preferred seal is glass the seal bonding the pin can be of any suitable composition so long as it exhibits the characteristics of the glass seals presently employed in hermetic refrigeration terminals manufactured by the Fusite Division of Emerson Electric Co., for example. Thus epoxy can be used, or phenolic resins either singly or bonded in turn with epoxy. The term bonded is used to embrace fusing and also adhering hermetically as by adhesive. These are merely illustrative.

Having thus described the invention, what is claimed and desired to be secured by Letters Patent is:

1. In a hermetic refrigeration terminal having a cup-shaped body with a generally flat bottom and at least one opening in said bottom defined by an annular sealing lip, a current conducting pin extending through said opening and beyond said lip on both ends thereof, the inner end of said pin being on the dish side and the outer end being on the outer side of said body, and a seal bonding said pin to an inside surface of said lip, the improvement comprising a flange extending generally radially from said pin and located axially between said lip and said inner end of said pin, and a sleeve surrounding said pin and extending axially between said flange and said lip, said sleeve being at least in part larger in diameter than said opening, said sleeve being bonded at its end opposite the flange to said seal.

2. The terminal of claim 1 wherein said flange is integral with said pin.

3. The terminal of claim 1 wherein a part of said sleeve projects within the opening defined by the lip.

4. The terminal of claim 3 wherein the part projecting within the opening and the part having a diameter larger than the diameter of the opening define between them a step having a part projecting radially along the free edge of the lip.

5. The terminal of claim 4 wherein the radially extending part of the step abuts the free edge of the lip.

6. The terminal of claim 4 wherein the radially extending part of the step is spaced axially from the free edge of the lip, and the intervening space is filled at least in part with bonding material.

7. The terminal of claim 3 wherein the said sleeve is tapered on the outside, flaring outwardly from the lip toward the flange

8. The terminal of claim 3 wherein at least a portion of the part of the sleeve projecting within the opening defined by the lip is spaced radially from the said lip, and the space is filled at least in part with bonding material.

9. The terminal of claim 1 wherein the sleeve has a rim on its end contiguous the flange, and the flange is seated within the compass of said rim.

10. The terminal of claim 9 including a sealing medium around said flange within said rim.

11. The terminal of claim 1 wherein the sleeve is spaced radially from the pin and the space is filled at least in part with bonding material.

12. The terminal of claim 1 wherein the sleeve is spaced axially from said lip and the space is filled at least in part with bonding material.

13. In a hermetic refrigeration terminal having a cup-shaped body with a generally flat bottom and at least one opening in said bottom defined by an annular sealing lip, a terminal pin extending through said opening and beyond said lip on both ends thereof, the inner end of said pin being on the dish side and the outer end being on the outer side of said body, and a glass seal bonding said pin to an inside surface of said lip, the improvement comprising a flange integral with said pin, extending radially from said pin and located axially between said lip and the inner end of said pin, and a ceramic sleeve having a cylindrical bore spaced from and surrounding said pin and extending axially between said flange and said lip, said sleeve being tapered to flare outwardly in the direction toward said flange on its outside, having a nose part extending within said opening and a flange-engaging part of a diameter greater than the diameter of said opening, said flange-engaging part having a rim surrounding said flange, and said glass seal extending through at least a part of the annular space between said sleeve and said pin.

* * * * *

UNITED STATES PATENT AND TRADEMARK OFFICE

CERTIFICATE OF CORRECTION

PATENT NO. : 4,296,275

DATED : October 20, 1981

INVENTOR(S) : Benjamin Bowsky

It is certified that error appears in the above—identified patent and that said Letters Patent is hereby corrected as shown below:

Column 1, line 30, "2,994,325" should read "2,944,325".

Column 5, line 21, "de Nemous" should read "de Nemours".

Signed and Sealed this

*Twenth-eighth* Day of *September 1982*

[SEAL]

*Attest:*

GERALD J. MOSSINGHOFF

*Attesting Officer*

*Commissioner of Patents and Trademarks*